US008400392B2

(12) United States Patent
Kimura et al.

(10) Patent No.: US 8,400,392 B2
(45) Date of Patent: Mar. 19, 2013

(54) APPARATUS AND METHOD FOR CONTROLLING BACKLIGHT AND LIQUID CRYSTAL DISPLAY

(75) Inventors: Kazuto Kimura, Kanagawa (JP); Masatake Hayashi, Kanagawa (JP); Tomio Aoki, Kanagawa (JP); Yoshihiro Katsu, Kanagawa (JP); Mitsuyasu Asano, Tokyo (JP)

(73) Assignee: Sony Corporation, Tokyo (JP)

( * ) Notice: Subject to any disclaimer, the term of this patent is extended or adjusted under 35 U.S.C. 154(b) by 1200 days.

(21) Appl. No.: 11/986,135

(22) Filed: Nov. 20, 2007

(65) Prior Publication Data

US 2008/0129680 A1 Jun. 5, 2008

(30) Foreign Application Priority Data

Dec. 1, 2006 (JP) ..... JP2006-325781

(51) Int. Cl.
*G09G 3/36* (2006.01)

(52) U.S. Cl. ..... 345/102; 349/61; 362/97.2

(58) Field of Classification Search ..... 345/102, 345/1.3

See application file for complete search history.

(56) References Cited

U.S. PATENT DOCUMENTS

| | | | | |
|---|---|---|---|---|
| 5,475,512 | A | 12/1995 | Nakazawa et al. | |
| 6,055,033 | A | 4/2000 | Yamaguchi et al. | |
| 6,580,476 | B2 | 6/2003 | Hasegawa | |
| 6,608,614 | B1 * | 8/2003 | Johnson | 345/102 |
| 6,633,301 | B1 | 10/2003 | Dallas et al. | |
| 6,636,282 | B2 | 10/2003 | Ogawa et al. | |
| 6,697,134 | B2 | 2/2004 | Watanabe et al. | |
| 6,799,865 | B2 | 10/2004 | Ellens et al. | |
| 6,817,735 | B2 | 11/2004 | Shimizu et al. | |
| 7,184,110 | B2 | 2/2007 | Kim et al. | |
| 7,201,493 | B2 | 4/2007 | Martynov et al. | |
| 7,213,960 | B2 | 5/2007 | Yoo | |
| 7,281,816 | B2 | 10/2007 | Suzuki | |
| 7,295,260 | B2 | 11/2007 | Harayama et al. | |

(Continued)

FOREIGN PATENT DOCUMENTS

| | | | |
|---|---|---|---|
| DE | 102004023186 | A1 | 12/2005 |
| EP | 1672706 | A | 6/2006 |

(Continued)

OTHER PUBLICATIONS

Poynton, "Digital Video and HDTV, Algorithms and Interfaces", Jan. 1, 2003, pp. 203-207, 224; Morgan Kaufmann, San Francisco, CA, USA.

(Continued)

*Primary Examiner* — Alexander Eisen
*Assistant Examiner* — Sanjiv D Patel
(74) *Attorney, Agent, or Firm* — Wolf, Greenfield & Sacks, P.C.

(57) ABSTRACT

Disclosed is a backlight control apparatus for controlling a backlight used in a liquid crystal display, the backlight having a lighting area that includes a plurality of blocks in each of which a backlight luminance is individually allowed to change. The apparatus includes a backlight control unit that calculates the backlight luminance of each block so that the absolute value of the difference between a backlight lighting ratio and 1 is at or below a first value, and controls the backlight so as to yield the calculated backlight luminances of the respective blocks, the backlight lighting ratio being the ratio between backlight set values of neighboring blocks.

18 Claims, 17 Drawing Sheets

U.S. PATENT DOCUMENTS

| | | | | |
|---|---|---|---|---|
| 7,324,080 | B1 | 1/2008 | Hu et al. | |
| 7,474,366 | B2 | 1/2009 | Haga et al. | |
| 7,502,010 | B2 * | 3/2009 | Kirk | 345/102 |
| 2001/0035853 | A1 | 11/2001 | Hoelen et al. | |
| 2003/0063062 | A1 | 4/2003 | Tsumura et al. | |
| 2005/0062698 | A1 * | 3/2005 | Hong | 345/87 |
| 2005/0073495 | A1 * | 4/2005 | Harbers et al. | 345/102 |
| 2005/0184952 | A1 | 8/2005 | Konno et al. | |
| 2005/0219443 | A1 | 10/2005 | Tanaka et al. | |
| 2006/0007111 | A1 | 1/2006 | Moon et al. | |
| 2006/0007367 | A1 | 1/2006 | Cho | |
| 2006/0044254 | A1 * | 3/2006 | Kirk | 345/102 |
| 2006/0120082 | A1 * | 6/2006 | Choo et al. | 362/276 |
| 2006/0152468 | A1 | 7/2006 | Ozaki | |
| 2006/0164580 | A1 | 7/2006 | Ueda et al. | |
| 2007/0115662 | A1 * | 5/2007 | Roberts et al. | 362/252 |
| 2007/0297172 | A1 | 12/2007 | Furukawa | |
| 2008/0036943 | A1 | 2/2008 | Matsumoto et al. | |
| 2008/0094345 | A1 * | 4/2008 | Tseng et al. | 345/102 |
| 2008/0100551 | A1 | 5/2008 | Haga et al. | |
| 2008/0111960 | A1 | 5/2008 | Yoshida et al. | |
| 2008/0174544 | A1 | 7/2008 | Ueda et al. | |
| 2008/0186433 | A1 | 8/2008 | Haga et al. | |
| 2008/0225197 | A1 | 9/2008 | Maruyama et al. | |
| 2009/0251400 | A1 * | 10/2009 | Liu et al. | 345/102 |

FOREIGN PATENT DOCUMENTS

| | | | |
|---|---|---|---|
| EP | 1863009 | A | 12/2007 |
| JP | 07-325214 | A | 12/1995 |
| JP | 10-260402 | A | 9/1998 |
| JP | 11-183891 | A | 7/1999 |
| JP | 2001-135118 | A | 5/2001 |
| JP | 2001-272938 | A | 10/2001 |
| JP | WO 01/84227 | A1 | 11/2001 |
| JP | 2002-099250 | A | 4/2002 |
| JP | 2003-131229 | A | 5/2003 |
| JP | 2003-207770 | A | 7/2003 |
| JP | 2003-228067 | A | 8/2003 |
| JP | 2003-233062 | A | 8/2003 |
| JP | 2003-532153 | A | 10/2003 |
| JP | 2003-331608 | A | 11/2003 |
| JP | 2004-118133 | A | 4/2004 |
| JP | 2004-212503 | A | 7/2004 |
| JP | 2004-246117 | A | 9/2004 |
| JP | 2005-091526 | A | 4/2005 |
| JP | 2005-100932 | A | 4/2005 |
| JP | 2005-234134 | A | 9/2005 |
| JP | 2005-242270 | A | 9/2005 |
| JP | 3766042 | | 2/2006 |
| JP | 2006-058484 | A | 3/2006 |
| JP | 2008-051905 | A | 3/2008 |
| JP | 2008-051950 | A | 3/2008 |
| JP | 2008-052131 | A | 3/2008 |
| JP | 2008-116914 | A | 5/2008 |
| JP | 2008-122713 | A | 5/2008 |
| WO | WO 2006/006537 | A1 | 1/2006 |
| WO | WO 2007/141732 | A | 12/2007 |

OTHER PUBLICATIONS

Moriya, N et al., "New Color Filter for Light-Emitting Diode Back Light", Japanese Journal of Applied Physics, Apr. 1, 2003, p. 1637-1641, vol. 42 No. 4A, Japan Society of Applied Physics, Tokyo, Japan.

* cited by examiner

APPARATUS AND METHOD FOR CONTROLLING BACKLIGHT AND LIQUID CRYSTAL DISPLAY

CROSS REFERENCES TO RELATED APPLICATIONS

The present invention contains subject matter related to Japanese Patent Application JP 2006-325781 filed in the Japanese Patent Office on Dec. 1, 2006, the entire contents of which are incorporated herein by reference.

BACKGROUND OF THE INVENTION

1. Field of the Invention

The present invention relates to apparatuses and methods for controlling a backlight and liquid crystal displays, and more particularly, to a backlight control apparatus and method capable of preventing unevenness in luminance of a liquid crystal display when the display is viewed from an oblique angle, and the liquid crystal display.

2. Description of the Related Art

Liquid crystal displays (hereinafter, LCDs) each include a liquid crystal panel and a backlight arranged on the rear of the panel. The liquid crystal panel includes a color filter substrate having a pattern of red, green, and blue color filters, and a liquid crystal layer.

In each LCD, changing a voltage applied to the liquid crystal layer controls the orientation (twisted states) of liquid crystal molecules. White light, coming from the backlight and transmitting through the liquid crystal layer according to the controlled states of the molecules, passes through the red, green, and blue color filters to produce red, green, and blue light beams, so that an image is displayed.

In the following description, the above-described control of changing an applied voltage to control the twisted states of liquid crystal molecules and change transmittance will be termed "aperture ratio control". In addition, the intensity of light which is emitted from a backlight, serving as a light source, and is incident on a liquid crystal layer will be called "backlight luminance". Further, the intensity of light which emerges from the front surface of a liquid crystal panel and is perceived by a viewer visually recognizing a displayed image will be called "display luminance".

In typical LCDs, while the whole of a screen of a liquid crystal panel is illuminated evenly by a backlight at a maximum backlight luminance, only the aperture ratio in each pixel of the liquid crystal panel is controlled to obtain the necessary display luminance in each pixel in the screen. For example, if the whole screen displays a dark image, the backlight emits light at the maximum backlight luminance. Disadvantageously, the power consumption is high and the contrast ratio is low.

To overcome the above-described disadvantages, for example, Japanese Unexamined Patent Application Publication Nos. 2004-212503 and 2004-246117 disclose methods of partitioning a screen into a plurality of segments and controlling the backlight luminance in each segment.

The above-described backlight control in each segment (hereinafter, referred to as "backlight partition control") will now be described with reference to FIGS. 1 to 3.

FIG. 1 shows an original image P1 displayed on an LCD. The original image P1 includes an elliptical dark region R1 having the lowest display luminance in substantially the center of the image. The display luminance of the image P1 gradually increases with distance from the region R1 toward the periphery of the image P1. The rate of change in display luminance from the dark region R1 to the periphery in an upper portion of the image P1 in FIG. 1 is larger than that in a lower portion thereof.

FIG. 2 schematically shows the structure of a backlight.

Referring to FIG. 2, the backlight has a lighting area including segments arranged in six rows (extending in the horizontal direction)×four columns (extending in the vertical direction), i.e., 24 segments.

When the backlight emits light corresponding to the original image P1, the backlight reduces the backlight luminance (i.e., attenuates light or reduces the amount of light) in each of two hatched segments in accordance with the display luminance of the region R1 of the original image P1.

Consequently, a backlight luminance distribution shown in FIG. 3 is obtained on the basis of the original image P1 of FIG. 1. In this distribution, the display luminance is the lowest in a substantially central portion of the lighting area and gradually increases toward the periphery. As described above, partially reducing the amount of light emitted from the backlight can lower the power consumption, thus increasing the dynamic range of display luminance.

Since the number of segments in the lighting area is generally smaller than the number of pixels in the liquid crystal panel, the display luminance distribution of the original image P1 in FIG. 1 does not agree with the backlight luminance distribution in FIG. 3. There are many pixels having the difference between the backlight luminance and the display luminance. For instance, although pixels arranged on a line Q-Q' of FIG. 3 have different backlight luminances, the corresponding pixels in the original image P1 have the same display luminance. In the backlight partition control, therefore, the aperture ratio in each pixel on the line Q-Q' is set higher than that without the backlight partition control so that the amount of transmitting light is larger than that without the backlight partition control. In the following description, apparent display luminance obtained by aperture ratio control, i.e., changing the aperture ratio so as to compensate for controlled backlight luminance will be termed "corrected display luminance".

FIG. 4 is a conceptual diagram showing the relationship between the backlight luminance and the corrected display luminance in the backlight partition control.

A backlight control unit for backlight partition control controls the aperture ratio in each pixel in a predetermined region so that the corrected display luminance distribution $M_{CL}$ is inverse to the backlight luminance distribution $M_{BL}$ in order to realize the same display luminance $T_0$ in the predetermined region. In this instance, the level of corrected display luminance depending on how much the aperture ratio is changed is determined by the transmittance characteristic of liquid crystal shown in FIG. 5.

The transmittance characteristic of liquid crystal obtained when a screen of an LCD is viewed from the front is typically used as reference. The transmittance characteristic shown in FIG. 5 is also obtained when the screen is viewed from the front (hereinafter, also referred to as "when viewed from an angle of 0 degree"). This transmittance characteristic has been previously evaluated and determined.

SUMMARY OF THE INVENTION

Users do not always view images displayed on screens of LCDs from the front. It is assumed that a user views a screen of an LCD from an oblique angle. Since liquid crystal has viewing angle characteristics, the transmittance characteristic of liquid crystal depends on the angle of viewing the screen (i.e., the viewing angle). FIG. 6 is a graph showing another transmittance characteristic, obtained when the screen of the LCD is viewed from a viewing point shifted in the horizontal direction from the front of the screen by 45 degrees, in addition to the transmittance characteristic obtained when viewed from an angle of 0 degree.

FIG. 6 shows the set gray scale, serving as an 8-bit set value for setting the transmittance of liquid crystal, plotted against the display luminance at a predetermined backlight luminance. FIG. 7 shows the luminance ratio of the display luminance obtained when viewed from an angle of 45 degrees to that obtained when viewed from an angle of 0 degree, the ratio being used for comparison between the display luminance obtained when viewed from an angle of 0 degree and that obtained when viewed from an angle of 45 degrees shown in FIG. 6.

Referring to FIGS. 6 and 7, in a set gray scale range lower than a point $\alpha$, the luminance (transmittance) obtained when viewed from an angle of 45 degrees is higher than that obtained when viewed from an angle of 0 degree. In addition, the rate of change in the luminance ratio each time the gray scale is changed by one step is high. On the other hand, in a set gray scale range higher than the point $\alpha$, the luminance obtained when viewed from an angle of 0 degree is higher than that obtained when viewed from an angle of 45 degrees and the rate of change in the luminance ratio each time the gray scale is changed by one step is lower than that in the lower gray scale range. Since the transmittance characteristic of liquid crystal depends on a liquid crystal mode, such as vertical alignment (VA) or in-plane switching (IPS), the characteristics are not limited to those shown in FIGS. 6 and 7.

The relationship between the backlight luminance and the corrected display luminance shown in FIG. 4 is typically calculated on the basis of the transmittance characteristic of liquid crystal obtained when the screen is viewed from an angle of 0 degree. When a corrected display luminance distribution $M_{CL}'$ in a case where the screen is viewed from an angle of 45 degrees is obtained on the basis of the transmittance characteristic of liquid crystal obtained when viewed from an angle of 45 degrees indicated by a dashed line in FIG. 6, the corrected luminance distribution $M_{CL}'$ is as shown in FIG. 8.

Referring to FIG. 8, a pixel having a minimum corrected display luminance (i.e., a maximum backlight luminance) is a pixel $x_\alpha$ corresponding to the point $\alpha$, where there is no difference between the display luminance obtained when viewed from an angle of 0 degree and that obtained when viewed from an angle of 45 degrees in FIGS. 6 and 7. The backlight luminance is indicated by $BL_\alpha$ and the corrected display luminance is indicated by $LC_\alpha$. It is assumed that a set gray scale level of each pixel other than the pixel $x_\alpha$ is set higher than that in the point $\alpha$.

In this case, the corrected display luminance distribution $M_{CL}'$ obtained when viewed from an angle of 45 degrees is lower than the corrected display luminance distribution $M_{CL}$ obtained when viewed from an angle of 0 degree. Consequently, the display luminance of each pixel other than the pixel $x_\alpha$ obtained when the screen is viewed from an angle of 45 degrees is deviated from the target display luminance $T_0$ by the difference between the corrected luminance distributions $M_{CL}$ and $M_{CL}'$, as shown by a bold long dashed line in FIG. 8.

In other words, in spite of the control of providing the same display luminance $T_0$, when the user views the screen from an angle of 45 degrees, pixels other than the pixel $x_\alpha$ have deviations from the target display luminance $T_0$ according to the backlight luminance distribution $M_{BL}$. If the ratio ($\Delta T/T_0$) of the maximum deviation $\Delta T$ to the display luminance $T_0$ is large, the pixels having the deviations are viewed as unevenness in luminance.

The present invention is made in consideration of the above-described circumstances and it is desirable to prevent unevenness in luminance when a screen is viewed from an oblique angle.

According to an embodiment of the present invention, there is provided a backlight control apparatus for controlling a backlight used in a liquid crystal display, the backlight having a lighting area that includes a plurality of blocks in each of which a backlight luminance is individually allowed to change. The apparatus includes a backlight control unit that calculates the backlight luminance of each block so that the absolute value of the difference between a backlight lighting ratio and 1 is at or below a first value, and controls the backlight so as to yield the calculated backlight luminances of the respective blocks, the backlight lighting ratio being the ratio between backlight set values of neighboring blocks.

In this embodiment, the backlight lighting ratio may be calculated on the condition that the absolute value of the difference between 1 and the ratio between the backlight luminances of pixels away from each other by a predetermined distance in the lighting area is at or below a second value.

According to another embodiment of the present invention, there is provided a method for controlling a backlight used in a liquid crystal display, the backlight having a lighting area that includes a plurality of blocks in each of which a backlight luminance is individually allowed to change. The method includes the steps of calculating the backlight luminance of each block so that the absolute value of the difference between a backlight lighting ratio and 1 is at or below a first value, and controlling the backlight so as to yield the calculated backlight luminances of the respective blocks, the backlight lighting ratio being the ratio between backlight set values of neighboring blocks.

According to another embodiment of the present invention, a liquid crystal display includes the following elements: A backlight has a lighting area including a plurality of blocks in each of which a backlight luminance is individually allowed to change. A backlight control unit calculates the backlight luminance of each block so that the absolute value of the difference between a backlight lighting ratio and 1 is at or below a first value, and controls the backlight so as to yield the calculated backlight luminances of the respective blocks, the backlight lighting ratio being the ratio between backlight set values of neighboring blocks.

According to the embodiments of the present invention, the backlight luminance of each block is calculated so that the absolute value of the difference between 1 and the backlight lighting ratio between the backlight set values of neighboring blocks is at or below the first value, and the backlight is controlled so as to yield the calculated backlight luminances of the respective blocks.

According to the embodiments of the present invention, the power consumption can be reduced and the dynamic range of display luminance can be increased.

According to the embodiments of the present invention, unevenness in luminance perceived by a user when the user views a screen of the liquid crystal display from an oblique angle can be prevented.

DESCRIPTION OF THE PREFERRED EMBODIMENTS

Before describing an embodiment of the present invention, the correspondence between the features of the present invention and the specific elements disclosed in an embodiment of the present invention and the drawings is discussed below. This description is intended to assure that embodiments supporting the claimed invention are described in this specification and the drawings. Thus, even if an element in the following embodiments or the drawings is not described as relating to a certain feature of the present invention, that does not necessarily mean that the element does not relate to that feature of the claims. Conversely, even if an element is described herein as relating to a certain feature of the claims, that does not necessarily mean that the element does not relate to other features of the claims.

According to an embodiment of the present invention, there is provided a backlight control apparatus (for example, a controller 13 in FIG. 9) for controlling a backlight used in a liquid crystal display, the backlight having a lighting area that includes a plurality of blocks in each of which a backlight luminance is individually allowed to change. The apparatus includes a backlight control unit (for example, a light source control unit 32 in FIG. 9) that calculates the backlight luminance of each block so that the absolute value of the difference between a backlight lighting ratio and 1 is at or below a first value, and controls the backlight so as to yield the calculated backlight luminances of the respective blocks, the backlight lighting ratio being the ratio between backlight set values of neighboring blocks.

According to another embodiment of the present invention, there is provided a method of controlling a backlight used in a liquid crystal display, the backlight having a lighting area that includes a plurality of blocks in each of which a backlight luminance is individually allowed to change. The method includes the steps of calculating the backlight luminance of each block so that the absolute value of the difference between a backlight lighting ratio and 1 is at or below a first value (for example, step S13 in FIG. 19), the backlight lighting ratio being the ratio between backlight set values of neighboring blocks, and controlling the backlight so as to yield the calculated backlight luminances of the respective blocks (for example, step S16 in FIG. 19).

An embodiment of the present invention will now be described with reference to the drawings.

Figure 1:
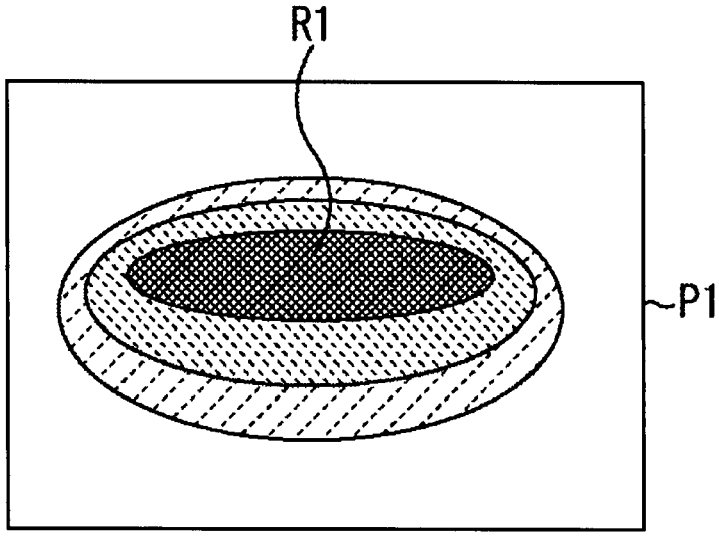
FIG. 1 is a diagram explaining backlight partition control.
Figure 2:
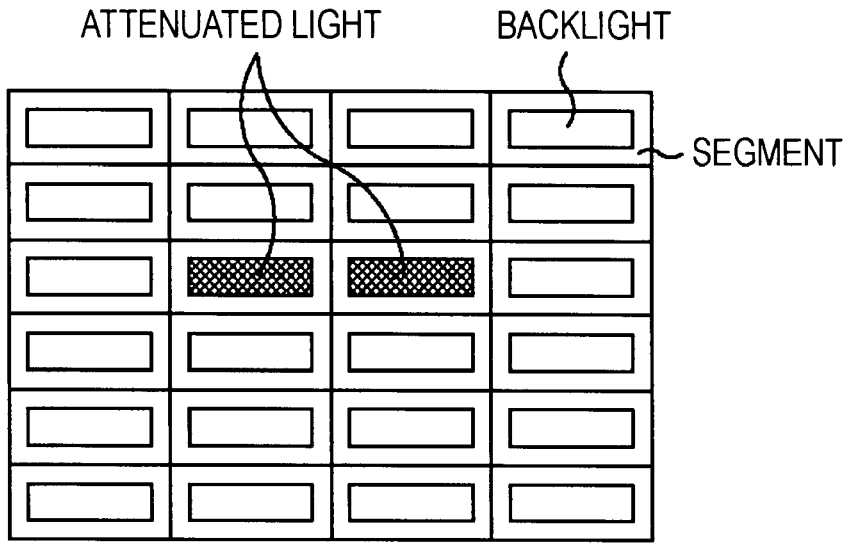
FIG. 2 is another diagram explaining the backlight partition control.
Figure 3:
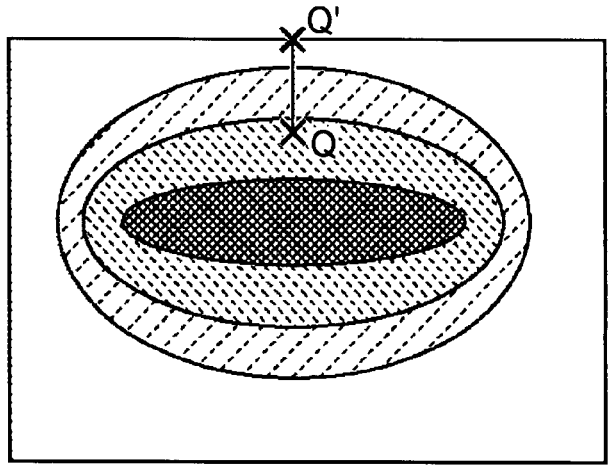
FIG. 3 is another diagram explaining the backlight partition control.
Figure 4:
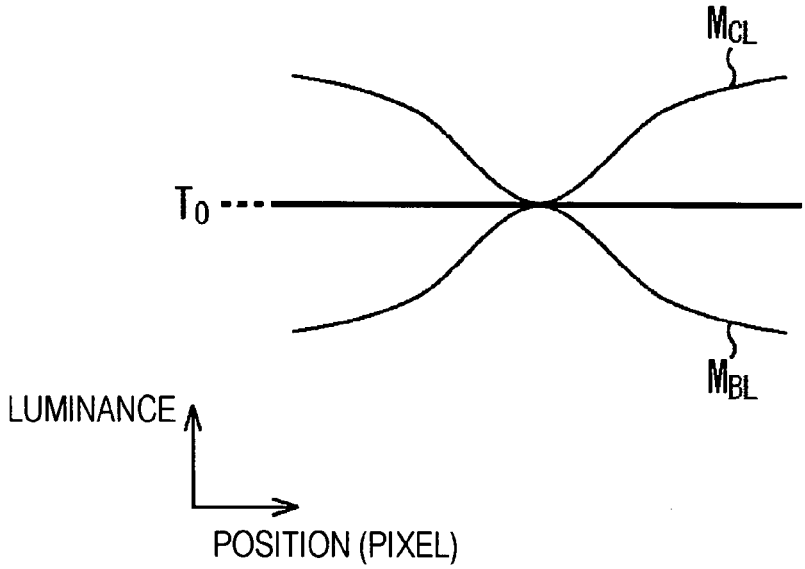
FIG. 4 is a conceptual diagram showing the relationship between backlight luminance and corrected display luminance in the backlight partition control.
Figure 5:
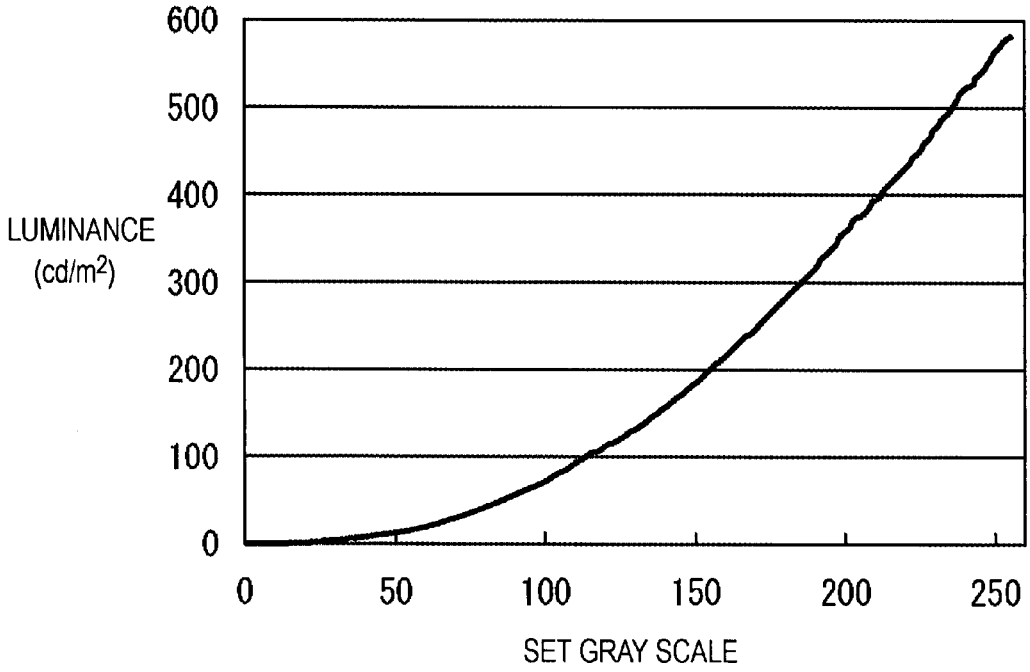
FIG. 5 is a graph showing the transmittance characteristic of liquid crystal when viewed from an angle of 0 degree.
Figure 6:
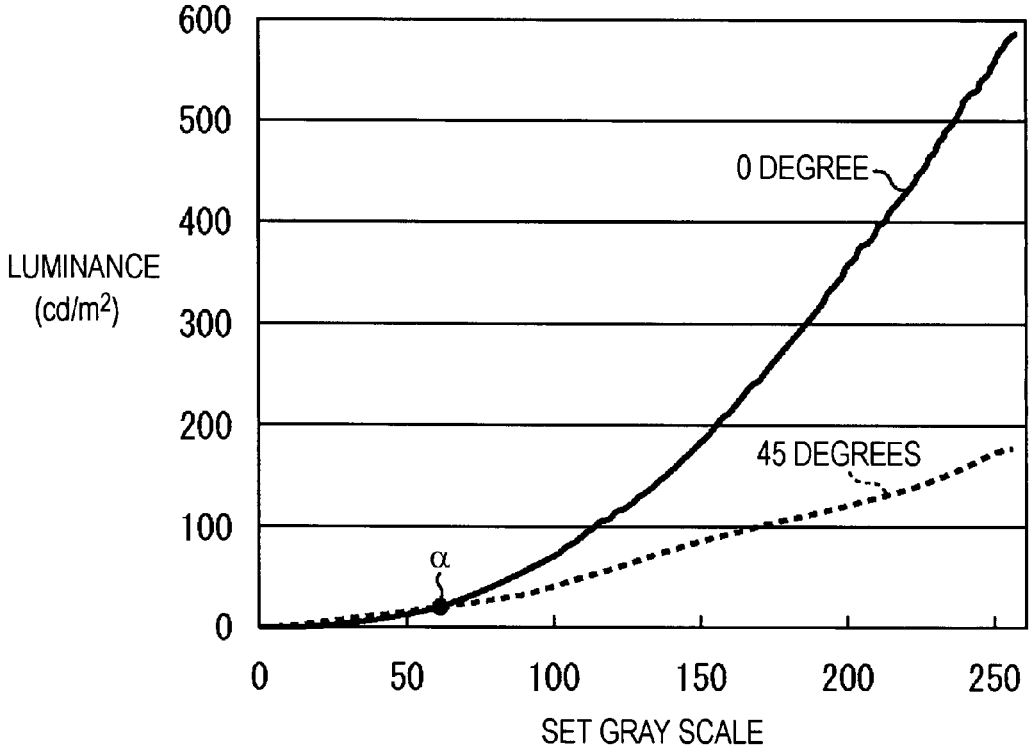
FIG. 6 is a graph showing the transmittance characteristic of liquid crystal when viewed from an angle of 0 degree and that when viewed from an angle of 45 degrees.
Figure 7:
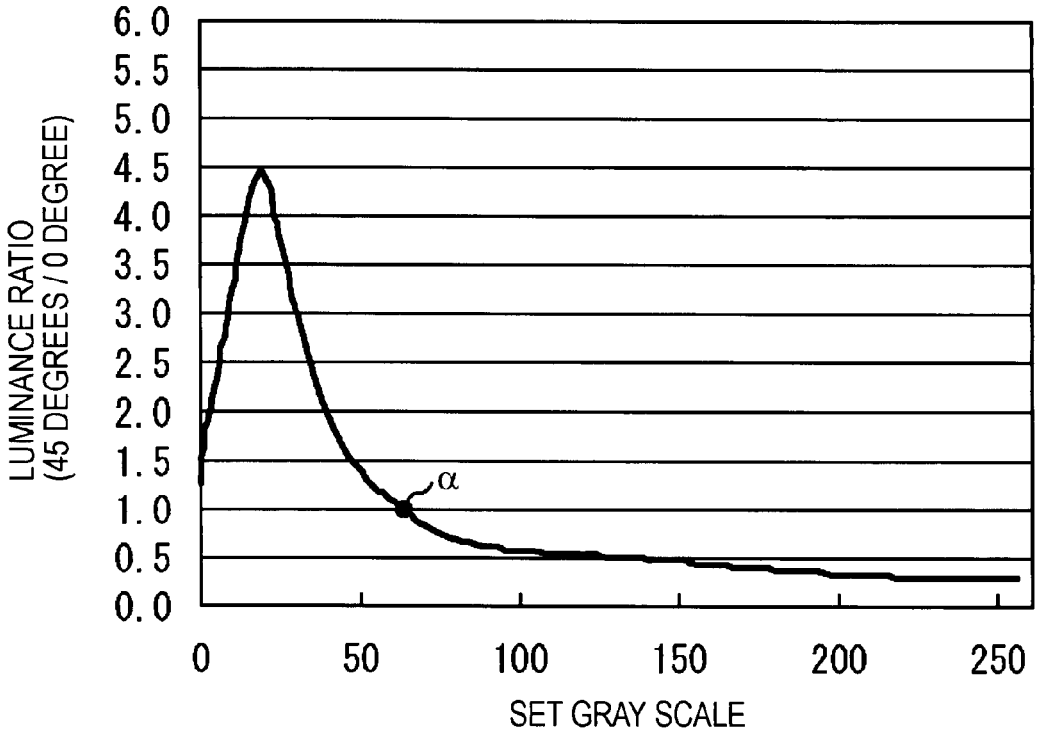
FIG. 7 is a graph showing the ratio of the luminance when viewed from an angle of 0 degree to that when viewed from an angle of 45 degrees.
Figure 8:
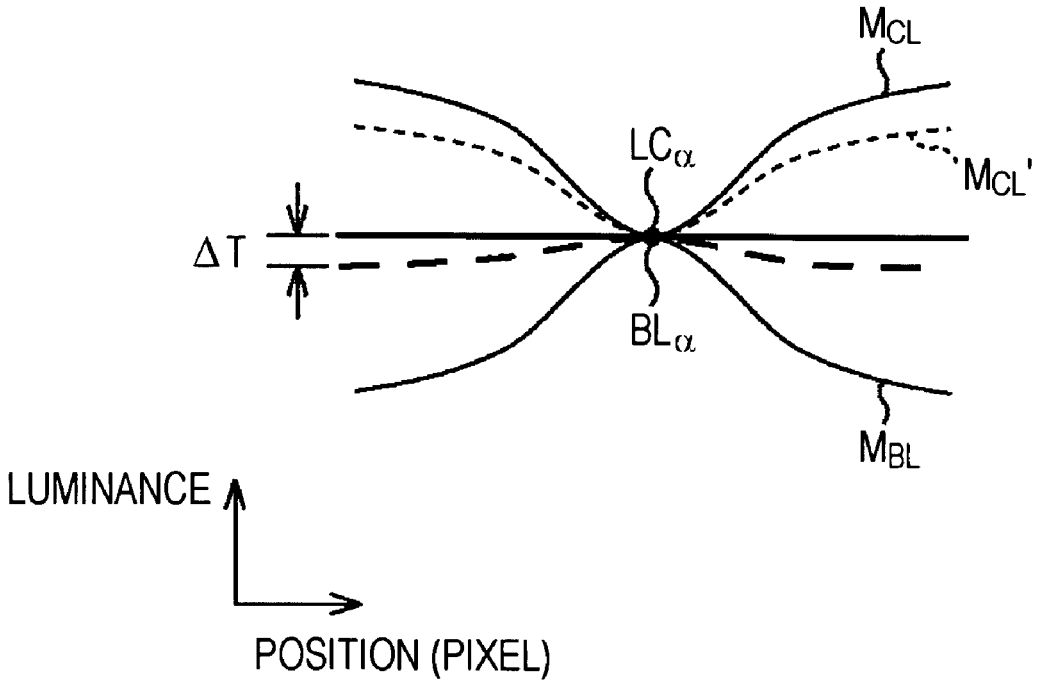
FIG. 8 is a diagram showing the relationship between backlight luminance and corrected display luminance when viewed from an angle of 45 degrees.
Figure 9:
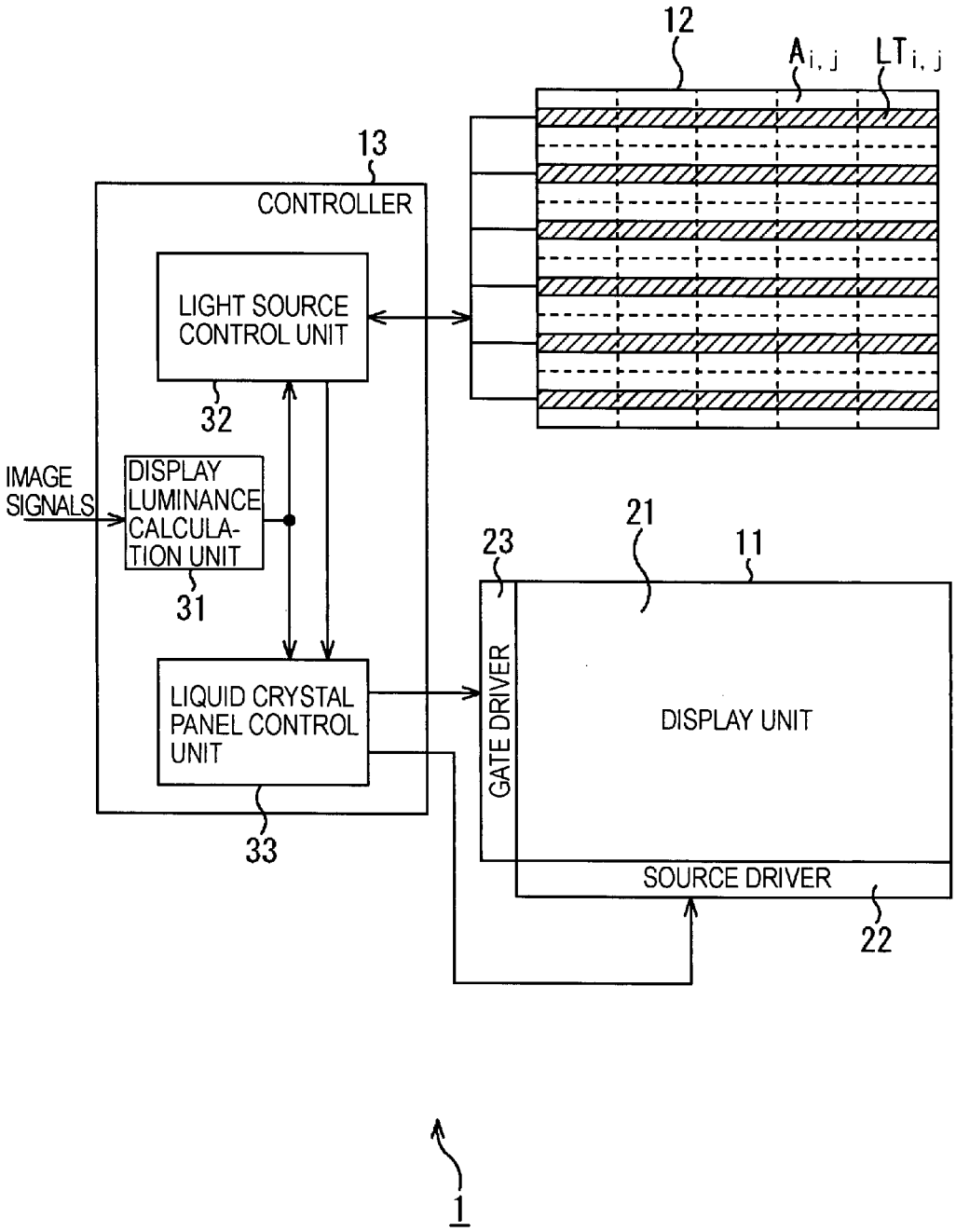
FIG. 9 is a block diagram illustrating the structure of a liquid crystal display according to an embodiment of the present invention.

FIG. 9 illustrates the structure of a liquid crystal display according to an embodiment of the present invention.

Referring to FIG. 9, a liquid crystal display (hereinafter, abbreviated to LCD) 1 includes a liquid crystal panel 11, a backlight 12 arranged on the rear of the liquid crystal panel 11, and a controller 13 for controlling the liquid crystal panel 11 and the backlight 12. The liquid crystal panel 11 includes a color filter substrate having a pattern of red, green, and blue color filters, and a liquid crystal layer.

The LCD 1 displays an original image corresponding to input image signals in a predetermined display area (i.e., a display unit 21). Image signals supplied to the LCD 1 correspond to an image having a frame rate of, for example, 60 Hz. The image will be referred to as "field image" hereinafter.

The liquid crystal panel 11 includes the display unit 21, a source driver 22, and a gate driver 23. The display unit 21 has a plurality of apertures that allow light emitted from the backlight 12 to pass therethrough. The source driver 22 and the gate driver 23 transmit drive signals to thin film transistors (TFTs), which are not shown in the diagram, arranged in the respective apertures in the display unit 21.

Light beams passing through the apertures enter the red, green, and blue color filters arranged in the color filter substrate (not shown), thus producing red, green, and blue light beams. A set of three apertures through which red, green, and blue light beams emerge, respectively, corresponds to a single pixel of the display unit 21. Each aperture through which a red, green, or blue light beam emerges corresponds to a sub pixel constituting the single pixel.

The backlight 12 emits white light in a lighting area opposed to the display unit 21. The lighting area of the backlight 12 includes a plurality of blocks (segments) and lighting modes of the respective blocks are individually controlled.

In the present embodiment, it is assumed that the lighting area of the backlight 12 includes 484 blocks arranged in 22 horizontal rows and 22 vertical columns. FIG. 9 shows an example of the backlight 12 including blocks arranged in five horizontal rows and six vertical columns because of the limited space of the drawing sheet.

A light source $LT_{i,j}$ is arranged in each block $A_{i,j}$. The light source $LT_{i,j}$ includes, for example, light emitting diodes (LEDs) emitting red, green, and blue light beams, respectively, the LEDs being arranged in a predetermined order. The light source $LT_{i,j}$ emits white light obtained by mixing the red, green, and blue light beams on the basis of a control signal supplied from a light source control unit 32.

Each block $A_{i,j}$ is not a physical segment obtained by physically dividing the lighting area of the backlight 12 using, for example, partition plates but a virtual segment corresponding to the light source $LT_{i,j}$. Accordingly, light emitted from the light source $LT_{i,j}$ is diffused by a diffuser (not shown), so that not only the corresponding block $A_{i,j}$ arranged in front of the light source $LT_{i,j}$ but also other blocks surrounding the block $A_{i,j}$ are irradiated with the diffused light.

The controller 13 includes a display luminance calculation unit 31, the light source control unit 32, and a liquid crystal panel control unit 33. The controller 13 functions as both of a liquid crystal panel control apparatus for controlling the liquid crystal panel 11 and a backlight control apparatus for controlling the backlight 12.

The display luminance calculation unit 31 receives image signals corresponding to a field image from another device. The display luminance calculation unit 31 obtains a luminance distribution of the field image from the supplied image signals and further calculates a display luminance $PN_{i,j}$ necessary for each block $A_{i,j}$ from the luminance distribution of the field image. The calculated display luminance $PN_{i,j}$ is supplied to each of the light source control unit 32 and the liquid crystal panel control unit 33.

The light source control unit 32 determines a backlight luminance $BL_{i,j}$ on the basis of each display luminance $PN_{i,j}$ supplied from the display luminance calculation unit 31. In this instance, the light source control unit 32 calculates the backlight luminance $BL_{i,j}$ so as to meet the following requirements in each pixel of the display unit 21: The ratio c (hereinafter, referred to as "luminance ratio c") of a backlight luminance BLx1 of a target pixel (for example, pixel x1) to a backlight luminance BLx2 (≦BLx1) of a pixel x2 away from the pixel x1 by a predetermined distance DS is at or below a maximum luminance ratio Cmax (c=BLx1/BLx2 (≧1)). The light source control unit 32 supplies the calculated backlight luminance $BL_{i,j}$ to the liquid crystal panel control unit 33.

In this instance, the maximum-luminance ratio Cmax is obtained on the condition that (maximum luminance ratio Cmax)≦(maximum error rate $\epsilon_{max}$)×(minimum perceptible luminance change level), i.e., the condition that unevenness in luminance is reduced to such a level that the unevenness is not visually perceptible by a user (human being) even when the user obliquely views the display unit.

The maximum error rate $\epsilon_{max}$ is a maximum value of an error rate $\epsilon$ obtained by the following expression:

$$(BLx1 \times LCx1 - BLx2 \times LCx2)/(BLx1 \times LCx1)|$$

where let LCx1 and LCx2 be the aperture ratios of the above-described pixels x1 and x2 in the lighting area of the backlight 12, respectively. Factors affecting the maximum error rate $\epsilon_{max}$ include 1) the viewing angle characteristics of liquid crystal, 2) parallax caused by spacing between liquid crystal and the diffuser, and 3) the accuracy of calculation. The most significant factor among them determines the maximum error rate $\epsilon_{max}$.

Figure 10:
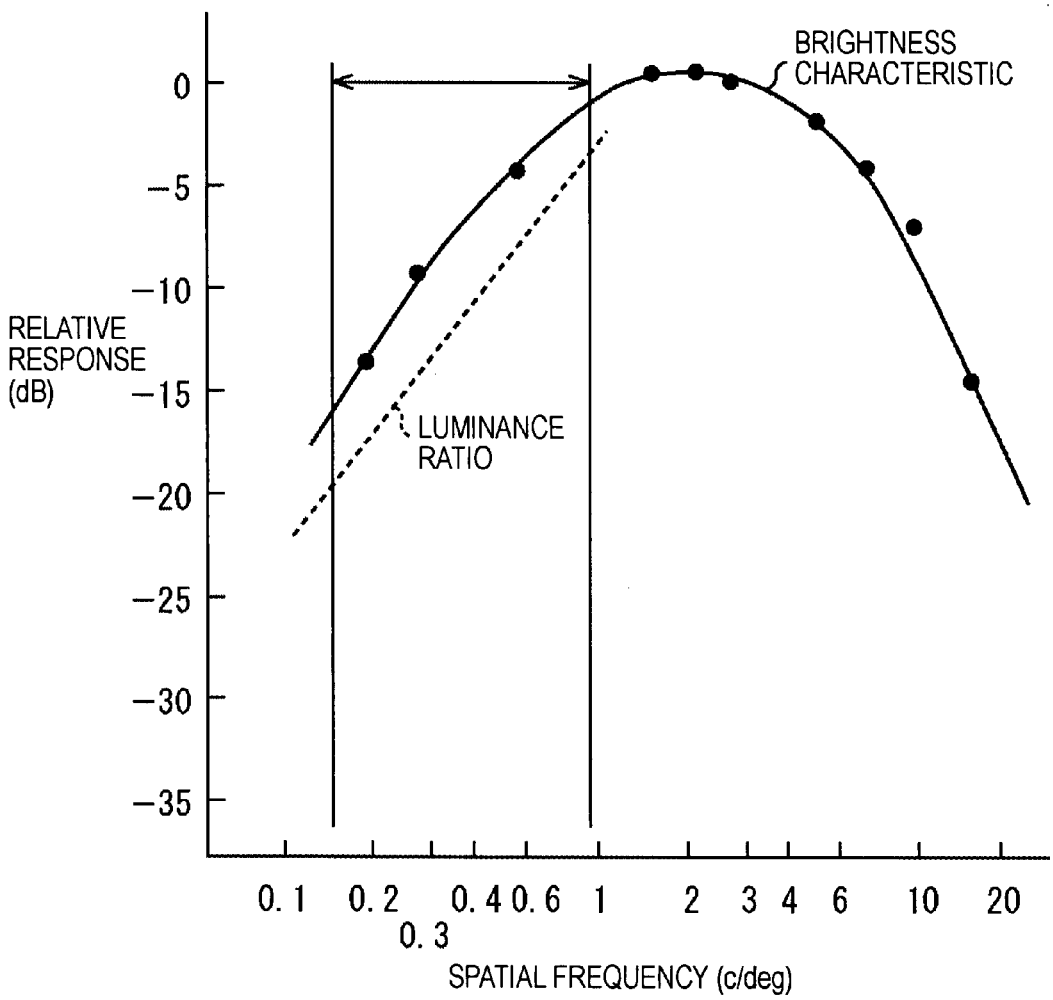
FIG. 10 is a graph explaining human visual perception.

The minimum perceptible luminance change level is the luminance ratio, at which the user (human eye) visually recognizes a difference in luminance (i.e., unevenness in luminance), obtained by sensory evaluation. As Weber's law describes, it is obvious that the perception, such as human visual sense, responds to the ratio of the intensities of stimuli rather than the difference therebetween. As indicated by a dashed line in FIG. 10, when luminance changes with a constant amplitude, the luminance ratio c increases in proportion to spatial frequency. Relative response also increases in proportion to the spatial frequency in a predetermined spatial frequency range indicated by arrows in FIG. 10. Consequently, the luminance ratio c has a constant differential threshold independently of the spatial frequency. Therefore, the minimum perceptible luminance change level can be defined as a constant value independently of the shape of a luminance distribution of the backlight luminances of the respective blocks.

As described above, the light source control unit 32 calculates each backlight luminance $BL_{i,j}$, meeting the requirements that the luminance ratio c is at or below the maximum luminance ratio Cmax, on the condition that (maximum luminance ratio Cmax)≦(maximum error rate $\epsilon_{max}$)×(minimum perceptible luminance change level). Since each unit to be controlled in the backlight 12 is a block, it is necessary to obtain a minimum value R of the ratio r of light-source set values of neighboring blocks so as to meet the requirements that the luminance ratio c is at or below the maximum luminance ratio Cmax. In this description, the ratio r of light-source set values of neighboring blocks will be termed "lighting ratio r" and the minimum value R of the lighting ratio r will be termed "minimum lighting ratio R". How to obtain the minimum lighting ratio R from the maximum luminance ratio Cmax will be described later with reference to FIG. 18. The light source control unit 32 obtains the minimum lighting ratio R satisfying the requirements that the luminance ratio c is at or below the maximum luminance ratio Cmax and calculates each backlight luminance $BL_{i,j}$ so as to satisfy the minimum lighting ratio R. Even if there is a considerable difference in display luminance between neighboring blocks, the minimum lighting ratio R (0<R<1) is a minimum required ratio. When there is no difference in display luminance between neighboring blocks, the lighting ratio r may be at or above the minimum lighting ratio R (it is no problem that the ratio r is at or above the minimum lighting ratio R).

The light source control unit 32 controls the backlight 12 so as to obtain the calculated backlight luminances $BL_{i,j}$ according to pulse amplitude modulation (PAM) control or pulse width modulation (PWM) control. In the following description, controlling the backlight luminances $BL_{i,j}$ so that the lighting ratio r is at or above the minimum lighting ratio R as described above will be called "interblock control". In the present embodiment, for example, assuming that the distance DS is set to 7.45 mm, the maximum luminance ratio Cmax is 1.02. When Cmax=1.02, the minimum lighting ratio R is 0.88.

The liquid crystal panel control unit 33 determines an aperture ratio for each pixel in the display unit 21 on the basis of the corresponding display luminance $PN_{i,j}$ supplied from the display luminance calculation unit 31 and the corresponding backlight luminance $BL_{i,j}$ supplied from the light source control unit 32. The liquid crystal panel control unit 33 supplies drive control signals to the source driver 22 and the gate driver 23 of the liquid crystal panel 11 so as to obtain the determined aperture ratios of the respective pixels, thus driving the TFTs of the pixels in the display unit 21.

The interblock control by the light source control unit 32 will now be described in more detail with reference to FIGS. 11 to 14.

Figure 11:
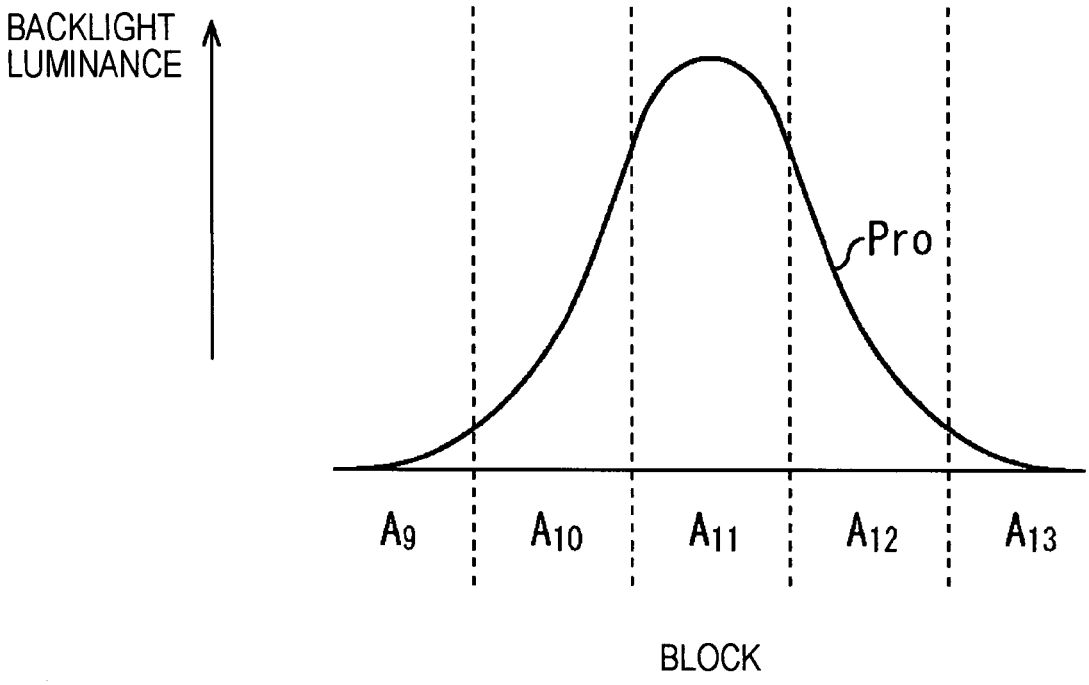
FIG. 11 is a diagram explaining interblock control.

FIG. 11 shows a luminance distribution (hereinafter, also referred to as "profile") Pro of a backlight luminance obtained when a light source in a single target block, e.g., a light source $LT_{11,11}$ in a target block $A_{11,11}$ at the center of the lighting area is independently allowed to emit light. Since an explanation relating to only blocks $A_{i,11}$ arranged in a single row (j=11) is made with reference to FIG. 11 to 14, a numerical value "11" indicating the row number "j" is omitted in the following description and FIGS. 11 to 14.

Figure 12:
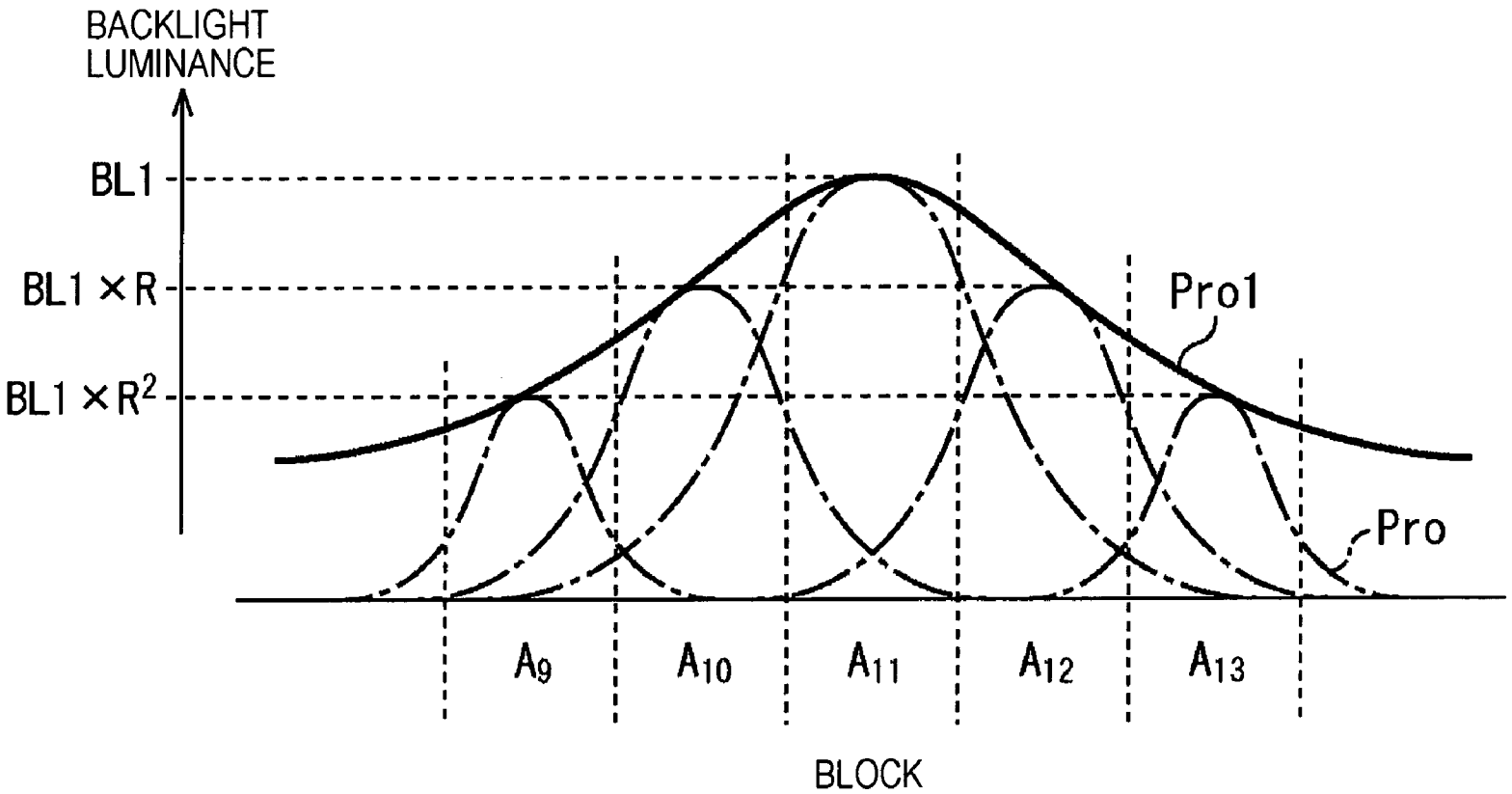
FIG. 12 is another diagram explaining the interblock control.

Referring to FIG. 12, in order to allow the light source $LT_{11}$ in the target block $A_{11}$ at a backlight luminance BL1, the lighting ratio r is set to the minimum lighting ratio R using a set value for the light source $LT_{11}$ in the target block $A_{11}$ as a reference (1) in the interblock control. It is therefore necessary to allow respective light sources in neighboring blocks $A_{10}$ and $A_{12}$ on both sides of the block $A_{11}$ to emit light at a backlight luminance (BL1×R) and it is further necessary to allow respective light sources in blocks $A_9$ and $A_{13}$ to emit light at a backlight luminance ($BL1 \times R^2$). Therefore, when the profile Pro obtained by independent emission using the light source $LT_{11}$ shown in FIG. 11 and the minimum lighting ratio R are determined, a synthetic profile Pro1 centered around the target block $A_{11}$ is inevitably determined.

Figure 13:
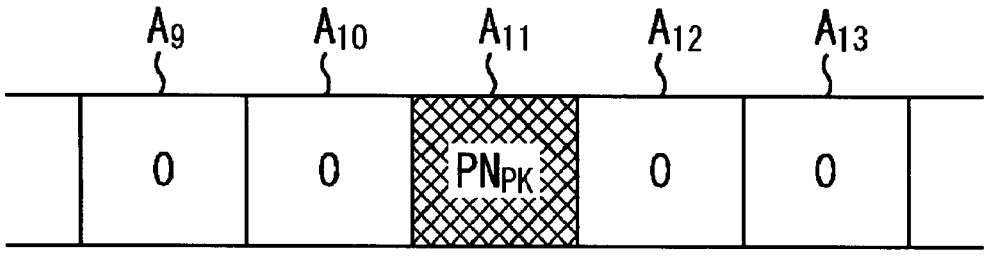
FIG. 13 is another diagram explaining the interblock control.
Figure 14:
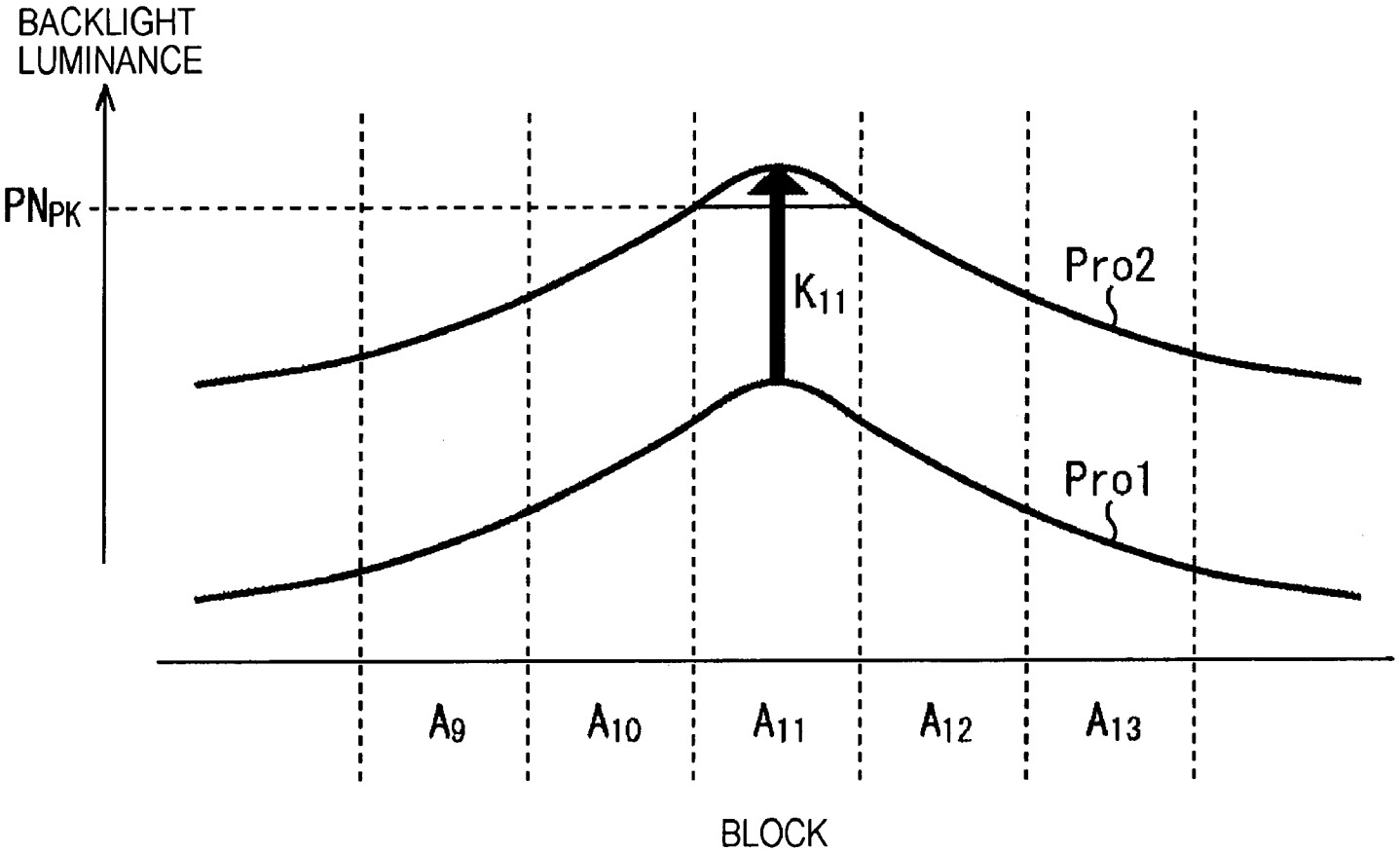
FIG. 14 is another diagram explaining the interblock control.

FIG. 13 shows a case where a display luminance $PN_{11}$ of the target block $A_{11}$ is a maximum display luminance (hereinafter, appropriately referred to as "peak luminance") $PN_{PK}$, which the backlight 12 can provide and which is the same as a display luminance obtained when backlight partition control is not performed, the light sources in the respective blocks $A_{i,j}$ emit light at the same output level of 100%, and the aperture ratio of each pixel is set to 100%, and respective display luminances $PN_9$, $PN_{10}$, $PN_{12}$, and $PN_{13}$ of the other blocks $A_9$, $A_{10}$, $A_{12}$, and $A_{13}$ in the same row are 0. The light source control unit 32 may calculate a drive factor $K_{11}$ to offset the synthetic profile Pro1 so as to obtain a synthetic profile Pro2 in which the peak luminance $PN_{PK}$ is satisfied in each pixel in the target block $A_{11}$ as shown in FIG. 14. In this instance, the drive factor $K_{11}$ is determined using the above-described peak luminance $PN_{PK}$ as a reference (1). In order to satisfy the peak luminance $PN_{PK}$ in each pixel of the target block $A_{11}$ by reducing the backlight luminance of each of the blocks $A_9$, $A_{10}$, $A_{12}$, and $A_{13}$ surrounding the target block $A_{11}$, it is necessary to set the set value in the target block $A_{11}$ to be higher than that in the case where the backlight partition control is not performed. Accordingly, the drive factor $K_{11}$ is equal to or higher than 1 (100%). Drive factors $K_{i,j}$ for all of blocks in the lighting area are not equal to or higher than 1 at the same time.

Figure 15:
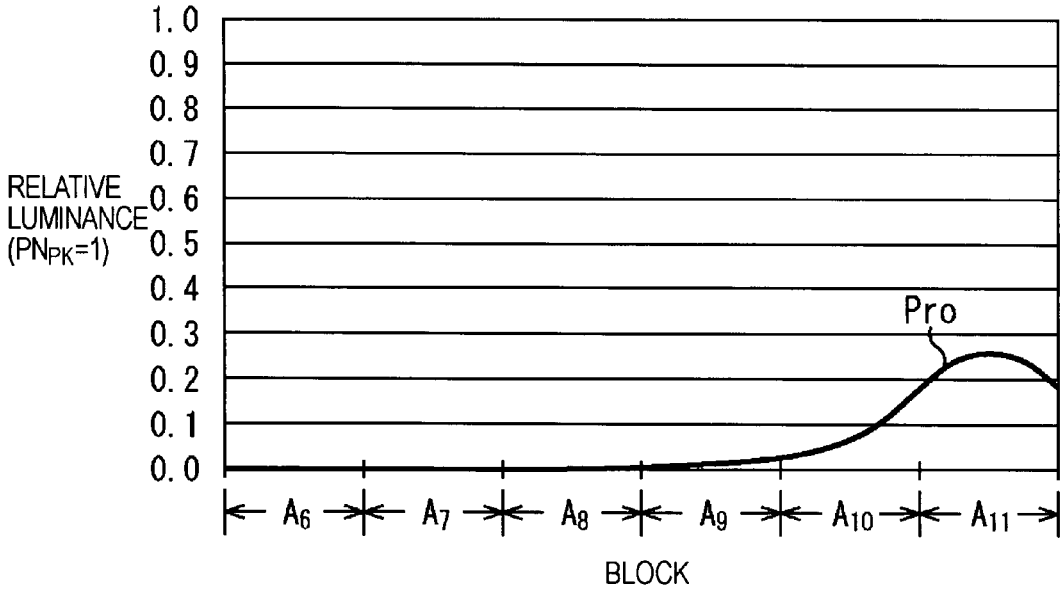
FIG. 15 is a diagram showing an example of a profile related to a single block.
Figure 16:
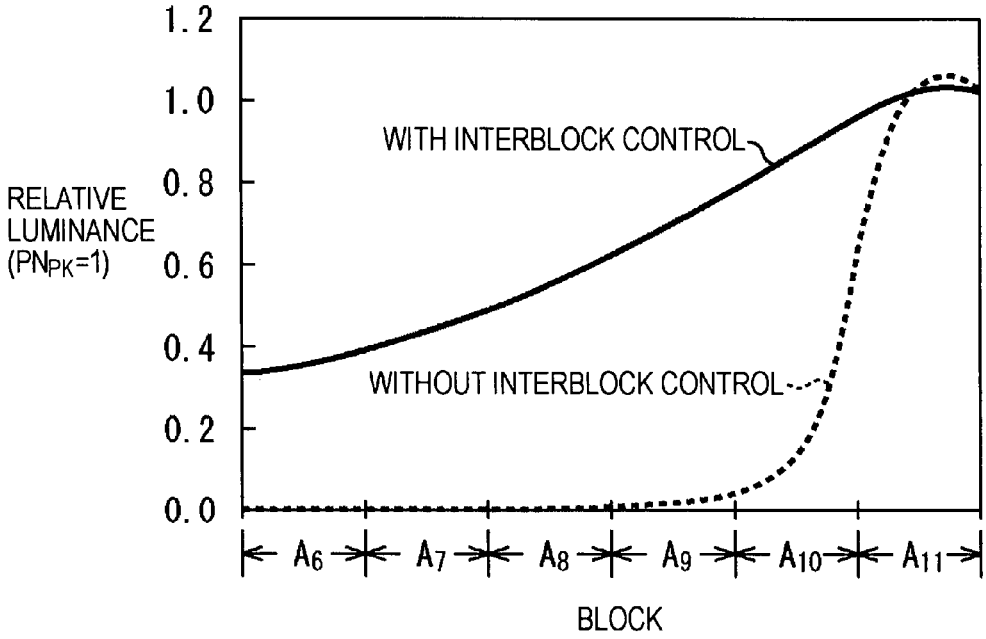
FIG. 16 is a diagram showing an example of a synthetic profile obtained with the interblock control.
Figure 17:
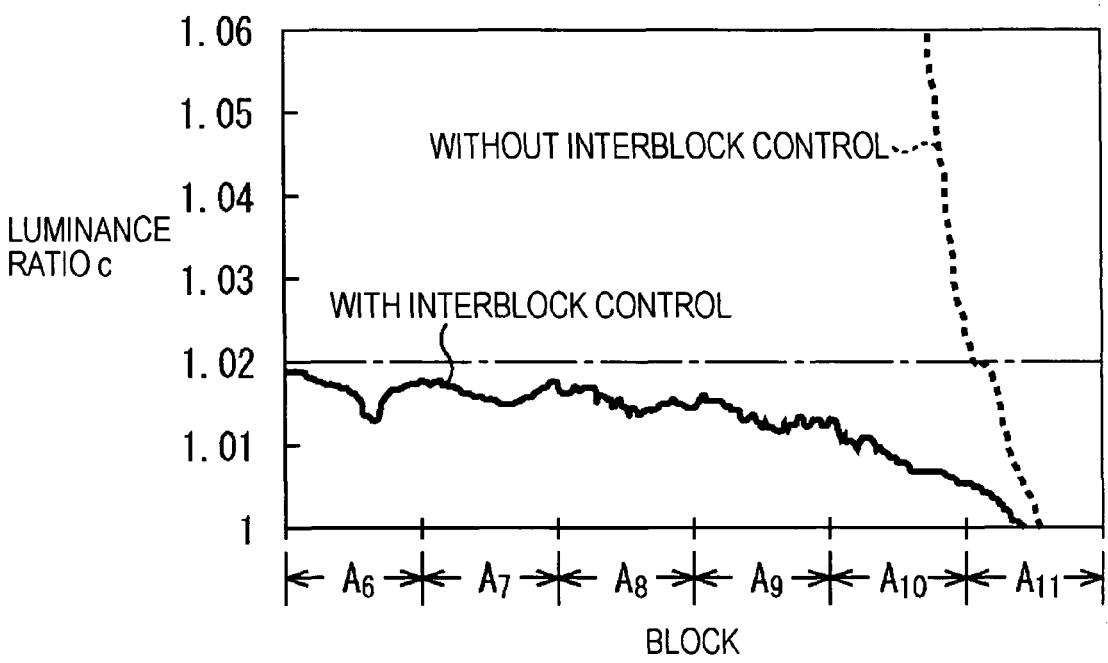
FIG. 17 is a diagram showing results of calculation of the luminance ratio.

FIGS. 15 to 17 show concrete examples of numerical values.

FIG. 15 shows the actual profile Pro obtained when the light source $LT_{11}$ in the block $A_{11}$ is independently allowed to emit light.

Referring to FIG. 15, the ordinate indicates the relative luminance represented by a relative value obtained when the peak luminance $PN_{PK}$ is a reference value ($PN_{PK}$=11) Since the profile Pro is indicated by a curve line that is symmetric with respect to the block $A_{11}$, right part of the profile curve line indicating the relative luminances of other blocks is omitted in FIG. 15.

The profile Pro of FIG. 15 is obtained under the following conditions: The light sources (and the backlight structure) are subjected to optical adjustment, e.g., current (PAM) control or PWM control, without backlight partition control so that the light sources in the respective blocks $A_{i,j}$ are turned on at the same output level of 100% so as to provide uniform luminance. The backlight structure is optically designed so that the maximum backlight luminance of the profile is set to a relative luminance of, for example, 0.26. The maximum backlight luminance is not necessarily set to 0.26. It is preferred that the maximum backlight luminance be at 0.20 or higher.

In light emission with the profile Pro of FIG. 15, when the display luminance $PN_{11}$ in the block $A_{11}$ is the peak luminance $PN_{PK}$ and the display luminance $PN_i$ ($i \neq 11$) in each of the other blocks $A_i$ ($i \neq 11$) in the jth row is calculated as "0" as shown in FIG. 13, the light source control unit 32 performs the interblock control on the blocks $A_6$ to $A_{10}$. A profile obtained in this case is shown in FIG. 16.

Referring to FIG. 16, a solid line indicates the profile obtained with the interblock control and a dotted line indicates a profile obtained without the interblock control. In the latter case without the interblock control, the drive factor for the block $A_{11}$ is used in a manner similar to the case of FIG. 13. In this instance, the drive factor $K_{11}$ is 1.25.

FIG. 17 shows a result of calculation of the luminance ratio c in the profile with the interblock control and that without the interblock control shown in FIG. 16.

Referring to FIG. 17, in the case of the profile with the interblock control, the luminance ratio c in each of the blocks $A_6$ to $A_{11}$ is less than the maximum luminance ratio Cmax (=1.02). In the case of the profile without the interblock control, the adjacent luminance ratios c in most of the blocks $A_6$ to $A_{10}$ are significantly higher than the maximum luminance ratio Cmax.

So long as the minimum lighting ratio R=0.88, the above-described control can be realized such that the luminance ratio c is at or below the maximum luminance ratio Cmax.

How to obtain the minimum lighting ratio R from the maximum luminance ratio Cmax will now be described with reference to FIG. 18.

When the profile Pro related to the light source $LT_{i,j}$ alone and the minimum lighting ratio R are determined as described above, the synthetic profile Pro1 is inevitably determined. The light source control unit 32 temporarily determines a plurality of minimum lighting ratios R and obtains the synthetic profile Pro1 on the basis of each of the temporarily determined ratios R. After that, the light source control unit 32 calculates the maximum luminance ratio Cmax with respect to each of the obtained synthetic profiles Pro1.

Figure 18:
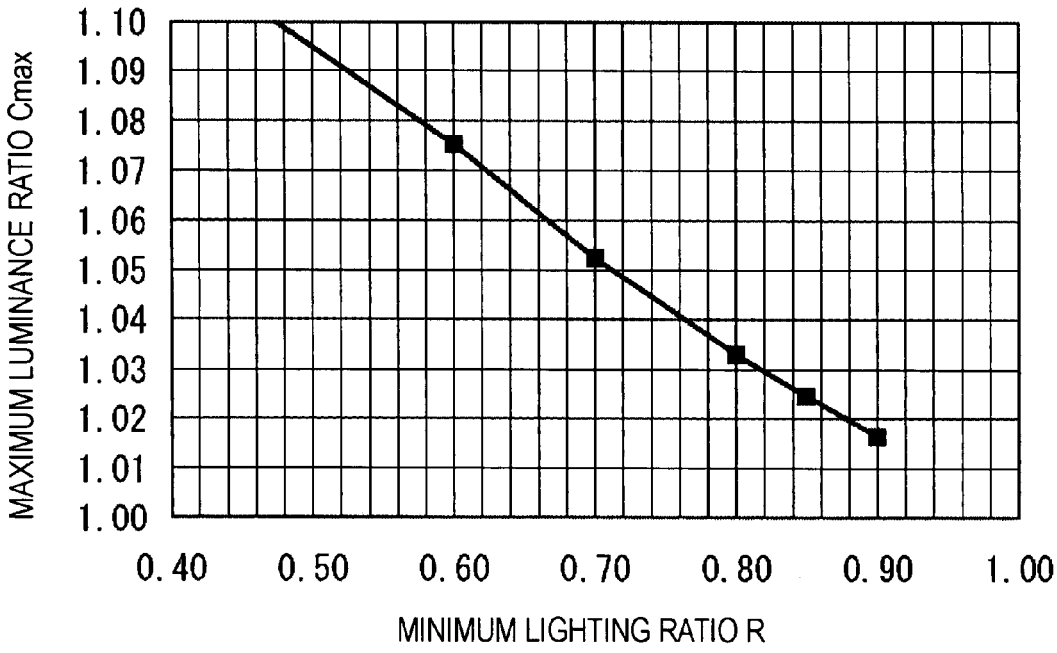
FIG. 18 is a graph explaining how to obtain a minimum lighting ratio.

FIG. 18 shows the maximum luminance ratio Cmax plotted against the minimum lighting ratio R temporarily determined. Referring to FIG. 18, when the minimum lighting ratio R ranges from 0.60 to 0.90, the relationship between the maximum luminance ratio Cmax and the minimum lighting ratio R can be regarded as linear. This range from 0.60 to 0.90 includes the minimum lighting ratio R plotted against the maximum luminance ratio Cmax=1.02. Therefore, the minimum lighting ratio R related to the target maximum luminance ratio Cmax (=1.02) can be calculated backward from the temporarily determined minimum lighting ratios R and the maximum luminance ratios Cmax based on the temporarily determined ratios R.

Figure 19:
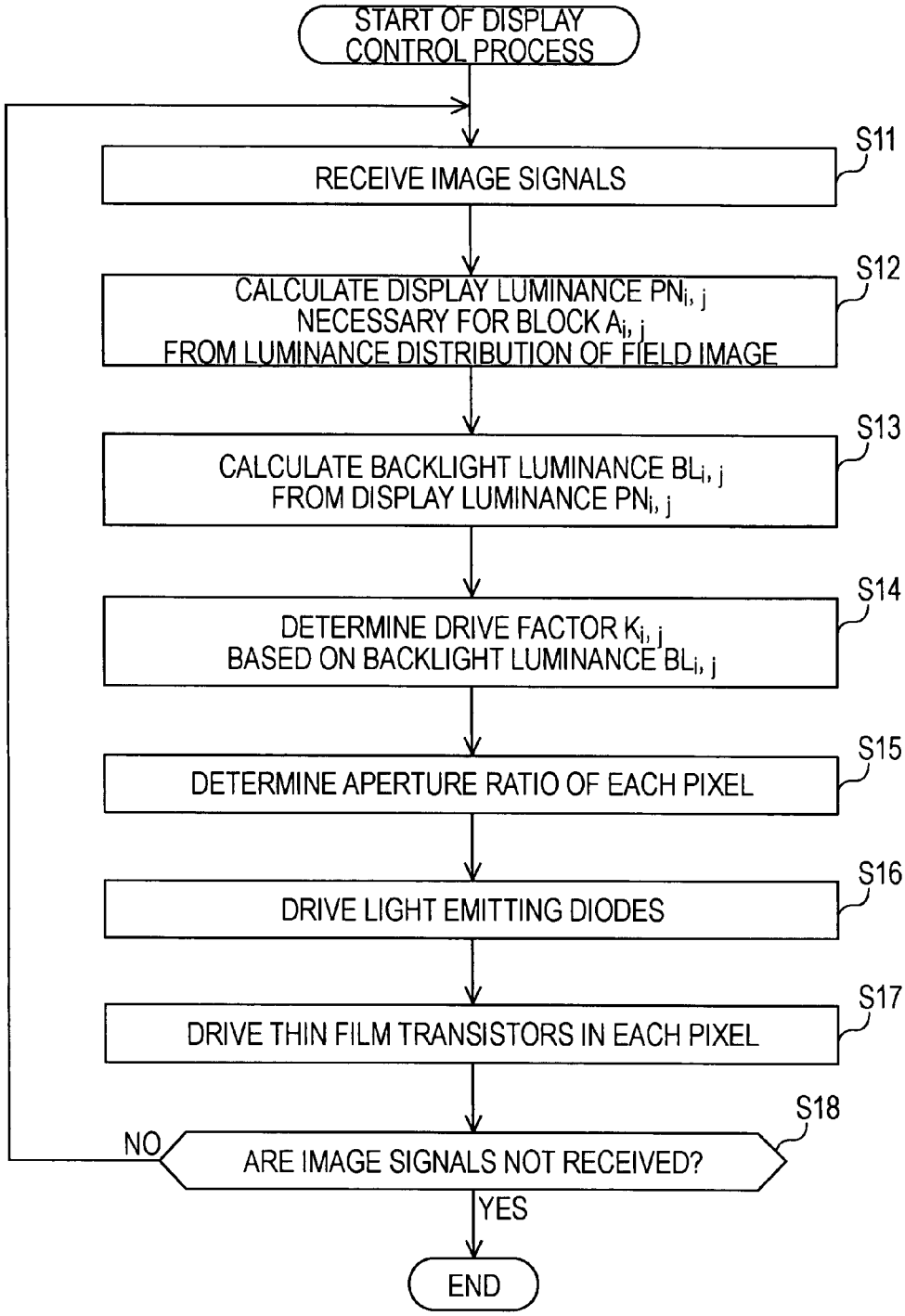
FIG. 19 is a flowchart explaining a display control process.

A display control process by the LCD 1 will now be described with reference to a flowchart of FIG. 19.

In step S11, the display luminance calculation unit 31 receives image signals supplied from another device. The image signals correspond to a single field image.

In step S12, the display luminance calculation unit 31 obtains a luminance distribution of the field image. Further, the display luminance calculation unit 31 calculates a display luminance $PN_{i,j}$ necessary for each block $A_{i,j}$ from the luminance distribution of the field image. The display luminance calculation unit 31 supplies the calculated display luminance $PN_{i,j}$ to each of the light source control unit 32 and the liquid crystal panel control unit 33.

In step S13, the light source control unit 32 calculates a backlight luminance $BL_{i,j}$ from each display luminance $PN_{i,j}$ so that the lighting ratio r is at or above the minimum lighting ratio R.

In step S14, the light source control unit 32 determines a drive factor $K_{i,j}$ on the basis of each backlight luminance $BL_{i,j}$.

In step S15, the liquid crystal panel control unit 33 determines an aperture ratio for each pixel in each block $A_{i,j}$ on the basis of the corresponding display luminance $PN_{i,j}$ supplied from the display luminance calculation unit 31 and the corresponding backlight luminance $BL_{i,j}$ supplied from the light source control unit 32.

In step S16, the light source control unit 32 drives the LEDs of each light source $LT_{i,j}$ on the basis of the drive factor $K_{i,j}$ for the corresponding block $A_{i,j}$.

In step S17, the liquid crystal panel control unit 33 supplies drive control signals to the source driver 22 and the gate driver 23 of the liquid crystal panel 11 to control the TFTs in each pixel of each block $A_{i,j}$ so as to obtain the corresponding aperture ratio determined previously.

In step S18, the display luminance calculation unit 31 determines whether image signals are not received. If it is determined that image signals are received, the process is returned to step S11 and steps S11 to S18 are repeated. Thus, the LCD 1 displays the next field image.

If it is determined in step S18 that image signals are not received, the process terminates.

As described above, the light source control unit 32 performs the interblock control to control light emission in each block at the corresponding backlight luminance $BL_{i,j}$ at which the lighting ratio r is at or above the minimum lighting ratio R, so that the luminance ratio c in each block can be set at or below the maximum luminance ratio Cmax. Advantageously, even if the user, who views the image displayed on the LCD 1, views the screen of the LCD 1 from an oblique angle, the user does not perceive any unevenness in luminance. The LCD 1 can prevent the occurrence of unevenness in luminance when the screen is viewed obliquely.

Since the controller 13 performs backlight partition control, it is obvious that the power consumption can be lower than that in a case without backlight partition control and the dynamic range of each display luminance can be wider than that in the case.

As described above, set values of the light sources of neighboring blocks are restricted under the predetermined conditions so that the luminance ratio c is controlled at or below the maximum luminance ratio Cmax. This control can also be realized simply by an optical system alone.

When let BLx1 and BLx2 be the backlight luminances of the pixels×1 and x2 in the lighting area of the backlight 12, respectively, and LCx1 and LCx2 be the aperture ratios for the pixels×1 and x2, respectively, a value expressed by $\{((BLx2-BLx1)/BLx1)/(x1-x2))\}$ may be controlled at a predetermined value (e.g., 4±1 (%/mm) instead of or in addition to the control of the luminance ratio c at or below the maximum luminance ratio Cmax.

The condition that the lighting ratio r is at or above the minimum lighting ratio R can be translated into a condition that the absolute value ($|r-1|$) of the difference between the lighting ratio r and 1 is at or below a first value T1. The other condition that the luminance ratio c is at or below the maximum luminance ratio Cmax can be translated into a condition that the absolute value ($|c-1|$) of the difference between the luminance ratio c and 1 is at or below a second value T2. The first value T1 is the absolute value of the difference between the minimum lighting ratio R and 1 ($T1=|R-1|$). The second value T2 is the absolute value of the difference between the maximum luminance ratio Cmax and 1 ($T2=|Cmax-1|$).

In this specification, steps described in the flowchart include not only processing in which the steps are carried out in time series in the described order but also processing in which the steps are carried out in parallel or individually rather than being implemented in time series.

It should be understood by those skilled in the art that various modifications, combinations, sub-combinations and alterations may occur depending on design requirements and other factors insofar as they are within the scope of the appended claims or the equivalents thereof.

What is claimed is:

1. A backlight control apparatus for controlling a backlight used in a display, the backlight having a lighting area that includes a plurality of blocks, each of the plurality of blocks containing a light source which controls a backlight luminance, the backlight luminance for each of the plurality of blocks individually allowed to change based at least in part on an image signal corresponding to an image to be displayed by the display, the apparatus comprising:

at least one backlight control circuit to receive the image signal and calculate the backlight luminance of each block based at least on the image signal so that an absolute value of a difference between a backlight lighting ratio and 1 is at or below a first value, and to control the backlight so as to yield the calculated backlight luminances of the respective blocks, the backlight lighting ratio being the ratio between backlight set values of neighboring blocks, wherein the light source of each of the plurality of blocks receives at least one control signal from the at least one backlight control circuit, the at least one control signal controlling the backlight luminance of an associated block.

2. The apparatus according to claim 1, wherein the backlight luminance of each block is calculated so that the absolute value of the difference between 1 and the ratio between the backlight luminances of pixels away from each other by a predetermined distance in the lighting area is at or below a second value.

3. A method of controlling a backlight used in a display, the backlight having a lighting area that includes a plurality of blocks, each of the plurality of blocks containing a light source which controls a backlight luminance, the backlight luminance for each of the plurality of blocks individually allowed to change based at least in part on an image signal corresponding to an image to be displayed by the display, the method comprising:

receiving the image signal;

calculating the backlight luminance of each block based at least on the image signal so that an absolute value of a difference between a backlight lighting ratio and 1 is at or below a first value, the backlight lighting ratio being the ratio between backlight set values of neighboring blocks; and controlling the light source of each of the plurality of blocks so as to yield the calculated backlight luminances of the respective blocks.

4. The method according to claim 3, wherein the backlight luminance of each block is calculated so that the absolute value of the difference between 1 and the ratio between the backlight luminances of pixels away from each other by a predetermined distance in the lighting area is at or below a second value.

5. A display comprising:

a backlight that has a lighting area including a plurality of blocks, each of the plurality of blocks containing a light source which controls a backlight luminance, the backlight luminance for each of the plurality of blocks individually allowed to change based at least in part on an image signal corresponding to an image to be displayed by the display and at least one backlight control circuit to receive the image signal and calculate the backlight luminance of each block based at least on the image signal so that an absolute value of a difference between a backlight lighting ratio and 1 is at or below a first value, and to control the backlight so as to yield the calculated backlight luminances of the respective blocks, the backlight lighting ratio being the ratio between backlight set values of neighboring blocks, wherein the light source of each of the plurality of blocks receives at least one control signal from the at least one backlight control circuit, the at least one control signal controlling the backlight luminance of an associated block.

6. The display according to claim 5, wherein the backlight luminance of each block is calculated so that the absolute value of the difference between 1 and the ratio between the backlight luminances of pixels away from each other by a predetermined distance in the lighting area is at or below a second value.

7. A backlight control apparatus for controlling a backlight used in a display, the backlight having a lighting area that includes a plurality of blocks, each of the plurality of blocks containing a light source which controls a backlight luminance, the backlight luminance for each of the plurality of blocks individually allowed to change based at least in part on an image signal corresponding to an image to be displayed by the display, the apparatus comprising:

at least one processor adapted to receive the image signal and calculate the backlight luminance of each block based at least on the image signal so that an absolute value of a difference between a backlight lighting ratio and 1 is at or below a first value, and to control the backlight so as to yield the calculated backlight luminances of the respective blocks, the backlight lighting ratio being the ratio between backlight set values of neighboring blocks, wherein the light source of each of the plurality of blocks receives at least one control signal from the at least one processor, the at least one control signal controlling the backlight luminance of an associated block.

8. A display comprising:

a backlight that has a lighting area including a plurality of blocks, each of the plurality of blocks containing a light source which controls a backlight luminance, the backlight luminance for each of the plurality of blocks individually allowed to change based at least in part on an image signal corresponding to an image to be displayed by the display; and at least one processor adapted to receive the image signal and calculate the backlight luminance of each block based at least on the image signal so that an absolute value of a difference between a backlight lighting ratio and 1 is at or below a first value, and to control the backlight so as to yield the calculated backlight luminances of the respective blocks, the backlight lighting ratio being the ratio between backlight set values of neighboring blocks, wherein the light source of each of the plurality of blocks receives at least one control signal from the at least one processor, the at least one control signal controlling the backlight luminance of an associated block.

9. The apparatus according to claim 1, wherein the first value is based on a minimum perceptible luminance change level.

10. The method according to claim 3, wherein the first value is based on a minimum perceptible luminance change level.

11. The display according to claim 5, wherein the first value is based on a minimum perceptible luminance change level.

12. The apparatus according to claim 7, wherein the first value is based on a minimum perceptible luminance change level.

13. The display according to claim 8, wherein the first value is based on a minimum perceptible luminance change level.

14. The apparatus according to claim 1, wherein the display is a liquid crystal display.

15. The method according to claim 3, wherein the display is a liquid crystal display.

16. The display according to claim 5, wherein the display is a liquid crystal display.

17. The apparatus according to claim 7, wherein the display is a liquid crystal display.

18. The display according to claim 8, wherein the display is a liquid crystal display.

* * * * *